United States Patent [19]

Preston

[11] 4,122,859

[45] Oct. 31, 1978

[54] CIGARETTE-MAKING MACHINES

[75] Inventor: Edward G. Preston, Deptford, England

[73] Assignee: Molins Limited, London, England

[21] Appl. No.: 646,113

[22] Filed: Jan. 2, 1976

Related U.S. Application Data

[63] Continuation of Ser. No. 449,808, Mar. 11, 1974, abandoned.

[30] Foreign Application Priority Data

Mar. 13, 1973 [GB] United Kingdom ..... 12033/73

[51] Int. Cl.[2] ..... A24C 5/00

[52] U.S. Cl. ..... 131/84 B; 131/110; 131/84 C

[58] Field of Search ..... 131/84 B, 84 C, 110

[56] References Cited

U.S. PATENT DOCUMENTS

| | | | |
|---|---|---|---|
| 2,827,058 | 3/1958 | Bogaty | 131/108 |
| 3,030,965 | 4/1962 | Labbe | 131/110 X |
| 3,030,966 | 4/1962 | Lanore | 131/84 BU X |
| 3,034,514 | 5/1962 | Pinkham | 131/84 B |
| 3,094,127 | 6/1963 | Gamberini | 131/84 B X |
| 3,139,972 | 7/1964 | Kochalski | 131/84 C |
| 3,297,040 | 1/1967 | Gamberini | 131/84 C |
| 3,490,463 | 1/1970 | Richter | 131/84 C X |
| 3,750,678 | 8/1973 | Labbe | 131/84 C |
| 3,779,252 | 12/1973 | Brackmann et al. | 131/84 B |
| 3,810,475 | 5/1974 | Labbe | 131/84 B |

*Primary Examiner*—Robert W. Michell
*Assistant Examiner*—V. Millin
*Attorney, Agent, or Firm*—John C. Smith, Jr.

[57] ABSTRACT

A cigarette making machine comprises a suction band, means for showering tobacco onto the band to build up a tobacco stream on the band, a first suction wheel which receives the tobacco stream from the band, and a second suction wheel which receives the tobacco stream from the first wheel and deposits it onto a continuous wrapper web in which the tobacco stream is enclosed to form a cigarette rod.

4 Claims, 5 Drawing Figures

CIGARETTE-MAKING MACHINES

This is a continuation, of application Ser. No. 449,808 filed Mar. 11, 1974 now abandoned.

U.S. Pat. No. 3,750,678 shows in the drawings a cigarette making machine in which tobacco is showered on to an air-pervious band to form a tobacco stream which is carried by means of suction. The shower is directed towards one run of the band, and the tobacco stream thus formed passes round a pulley and is then trimmed while moving along a second run of the band. The trimmed filler stream is then transferred to a continuous wrapper web by means of a suction wheel which receives the trimmed tobacco stream directly from the band and carries it on to the wrapper web.

The present application is concerned with an improvement or modification which has the advantage of the above machine of allowing the use of a band which is substantially wider than the tobacco stream, and also has additional advantages.

According to the present invention, a cigarette making machine comprises a suction band, means for showering tobacco onto the band to build up a tobacco stream on the band, a first suction wheel which receives the tobacco stream from the band, and a second suction wheel which receives the tobacco stream from the first wheel and deposits it onto a continuous wrapper web in which the tobacco stream is enclosed to form a cigarette rod.

Preferably the machine includes a trimming device which is adjacent to the band and removes part of the tobacco stream while the stream is on the band.

In a preferred machine according to this invention the band has a substantially horizontal lower run onto which the tobacco is showered through an upwardly extending channel, and a trimmer which is adjacent to the lower run of the band, the first suction wheel being at or near the end of the lower run of the band. This facilitates tensioning of the band in that tensioning can be achieved by moving one of the pulleys which is clear of tobacco.

Apparatus in accordance with the invention, for forming a continuous tobacco filler in a cigarette-making machine, will now be described by way of example with reference to the accompanying drawings, in which.

Figure 1:
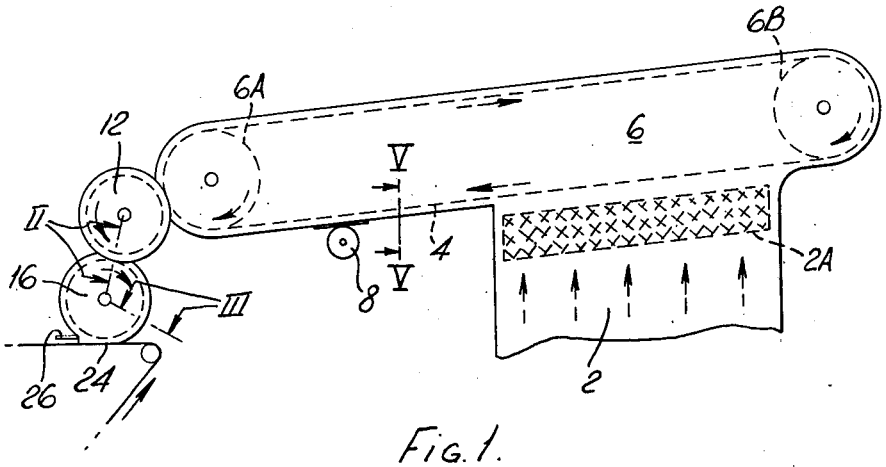
FIG. 1 is a schematic sectional elevation diagrammatically illustrating apparatus according to the invention.
Figure 5:
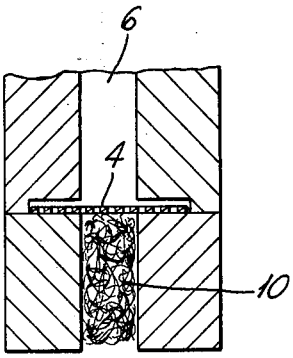
FIG. 5 is a sectional view taken along the line V—V in FIG. 1.

As shown in FIG. 1, tobacco is showered upwards through a chimney 2 towards the lower run of an air pervious band 4 running round a suction chamber 6. Air flows up the chimney partly through the effect of suction applied to a louvre port 2A in one wall of the chimney. The suction chamber 6 includes pulleys 6A and 6B around which the band passes. A tobacco stream thus builds up on the underneath surface of the band 4 and is then trimmed by a trimmer 8. The suction band 4 is substantially wider than the tobacco stream as shown in FIG. 5. The arrangement so far described may be basically in accordance with U.S. Pat. No. 3,019,793.

Figure 2:
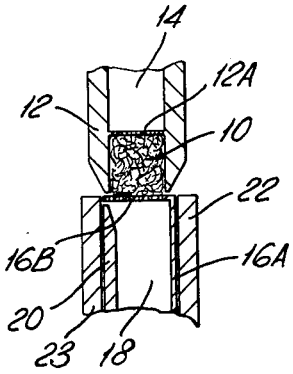
FIG. 2 is a sectional view taken along the line II—II in FIG. 1.
Figure 3:
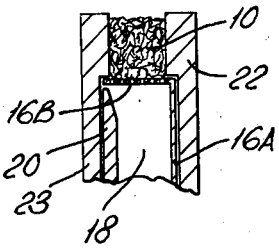
FIG. 3 is a sectional view taken along the line III—III in FIG. 1.

The trimmed tobacco stream, identified by the reference numeral 10 in FIG. 2, is then received by a peripherally grooved transfer wheel 12. A bottom wall 12A of the groove is air-pervious so that suction in a space 14 in the wheel acts to hold the tobacco stream 10 on the wheel.

The wheel 12 rotates in a counter-clockwise direction as shown, and transfers the tobacco stream to a wheel 16 rotating in a clockwise direction. This wheel 16 comprises a disc 16A (see FIG. 2) which carries an air-pervious peripheral portion 16B. A suction space 18 within the wheel is completed by a fixed stator wall 20. On opposite sides of the wheel 16 there are fixed side walls 22 and 23 which confine the sides of the tobacco stream while it is being carried by the wheel 16.

After passing approximately halfway around the wheel 16, the tobacco stream arrives on a continuous wrapper web 24, at which point suction ceases to be applied through the rim 16B of the wheel 16. A fixed shoe 26 extending to close to the rim 16B of the wheel 16 helps to remove the tobacco stream from the wheel and then holds the tobacco stream in compression. This last function is then continued by a garniture tongue (not shown) which further compresses and shapes the tobacco stream until it is enclosed in the wrapper web 24.

The band can be tensioned by urging the pulley 6A to the left.

It should be noted that the tobacco stream is transferred smoothly and without disturbance from the band 4 to the wheel 12 and then from the wheel 12 to the wheel 16, for which purpose the wheels 12 and 16 have peripheral speeds substantially equal to the speed of the band. The trimmer 8 may have provision for leaving extra quantities of tobacco at regular intervals to produce denser cigarette ends, for example as described in U.S. Pat. No. 3,032,041.

The transfer of the tobacco stream from the band to the wheel 12 and then from the wheel 12 to the wheel 16 is preferably carried out in the manner described in U.S. Pat. No. 3,871,386.

Instead of the wheel 12 being peripherally grooved, it could be formed like the wheel 16, with fixed side guides to confine the sides of the tobacco stream.

Instead of the wheel 12 receiving the tobacco stream while it is passing round the pulley 6A, the wheel 12 could be below the pulley 6A so as to receive the tobacco stream at or near the end of the lower run of the band.

Figure 4:
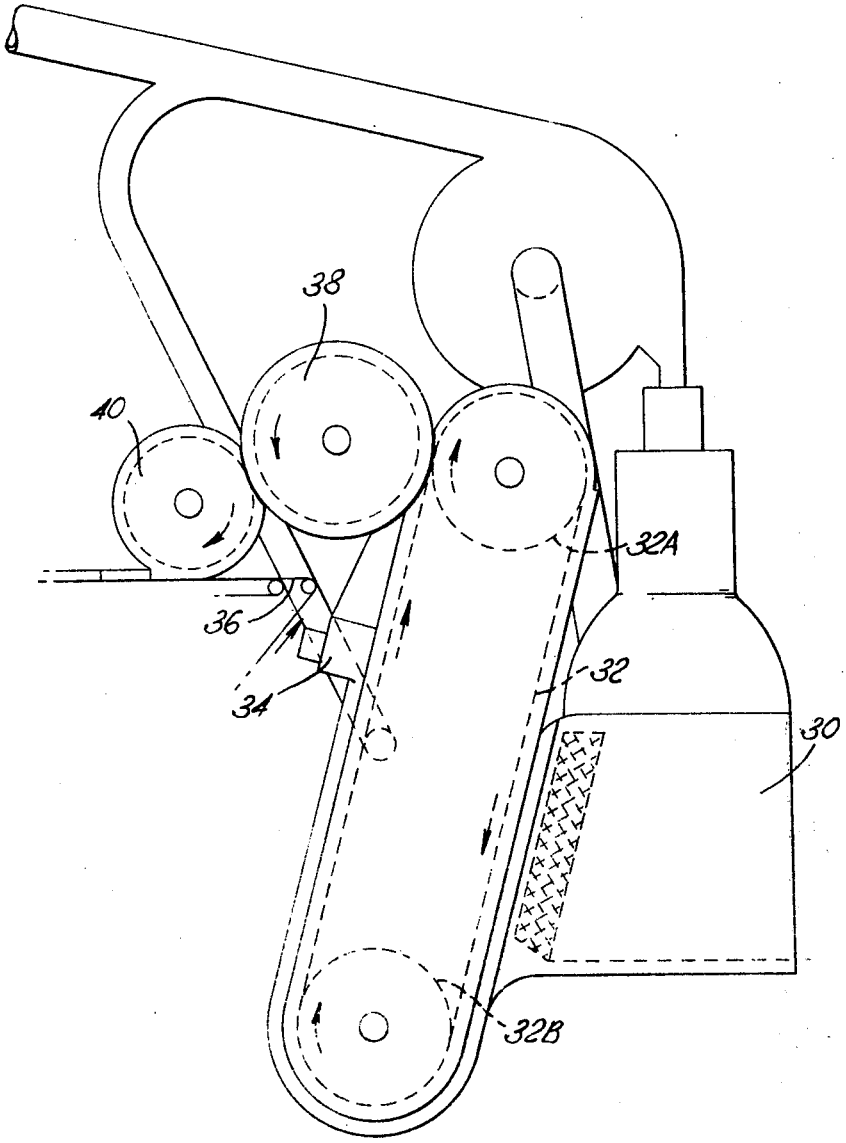
FIG. 4 is a schematic sectional elevation diagrammatically illustrating apparatus according to another embodiment of the invention.

FIG. 4 shows a machine in which tobacco is showered through a horizontal chimney or channel 30 towards one run of a band 32 which runs across the discharge end of the channel 30 and passes around pulleys 32A and 32B. A trimmer 34 is arranged adjacent to a second run of the band where the band is moving upwards. The trimmed tobacco stream is then transferred to a wrapper web 36 via transfer wheels 38 and 40 in the same manner as in the first example.

The tobacco may be delivered into the channel 30 in the manner described in U.S. Pat. No. 3,851,652 or U.S. application Ser. No. 275,635 filed July 27, 1972; FIG. 4 shows in outline a tobacco carpet forming system in accordance with this last application. Compared with the arrangement described in U.S. Pat. No. 3,851,652, the arrangement shown in the present FIG. 4 has the advantage that the band (and its associated equipment)

is lower and therefore more accessible to the machine operator.

Instead of the trimmer 34 being adjacent to the band 32 it could be adjacent to the wheel 38.

I Claim:

1. A cigarette making machine comprising:

(a) conveyor means including a plurality of spaced rotatably mounted pulleys and an endless air-pervious band arranged to pass along a path about said pulleys, (b) means for driving said conveyor means in a direction such that a portion of said endless band moves in an upward direction, (c) means spaced from said upwardly moving portion of said endless band for conveying a continuous wrapper web in a direction away from said endless band and along a substantially horizontal path, (d) means for showering tobacco onto said endless band to build up a tobacco stream on said endless band at a first position on said path upstream of said upwardly moving portion, (e) a trimming device adjacent said endless band at a position on said path between said first position and said upwardly moving portion of said endless band and arranged to remove a portion of said tobacco stream while said stream is on said endless band, (f) a first suction wheel, having an air-pervious peripheral surface arranged to travel along a first circular path, a portion of which is adjacent to said upwardly moving portion of said endless band, and in a direction such that the adjacent portions of said peripheral surface of said first suction wheel and of said endless band travel in the same direction, for receiving said trimmed tobacco stream smoothly and without disturbance from said endless band at a first position along said first circular path and conveying said trimmed tobacco stream along said first circular path, (g) a second suction wheel, having an air-pervious peripheral surface arranged to travel along a second circular path, a portion of which is adjacent to the peripheral surface of said first suction wheel, and in a direction such that the adjacent portions of said peripheral surfaces of said first and second suction wheels travel in the same direction, for receiving said trimmed tobacco stream smoothly and without disturbance from the peripheral surface of said first suction wheel at a second position along said first circular path downstream of said first position, conveying said trimmed tobacco stream along a portion of said circular path and depositing it onto the top surface of said continuous wrapper web, (h) suction means for directing an air stream through at least a part of said air-pervious endless band and said first and second suction wheels to retain said tobacco stream on said endless band and said peripheral surfaces of both said first and second suction wheels, and (i) a pair of spaced stationary side walls adjacent to and extending transversely of said peripheral surface of one of said suction wheels, said side walls having spaced confronting surfaces for confining the opposite sides of said tobacco stream while it is on said peripheral surface of said one wheel, said spaced confronting surfaces of said stationary side walls extending along one of said circular paths from a location immediately downstream of the position where said tobacco stream is transferred to said one suction wheel to a location adjacent said position where said tobacco stream is transferred therefrom, the other of said suction wheels including a peripheral groove defined by an air-pervious cylindrical bottom wall and spaced side walls projecting radially from opposite sides thereof, the confronting surfaces of said side walls of said other suction wheel being spaced substantially the same distance as the confronting surfaces of said stationary side walls of said one suction wheel.

2. A cigarette making machine according to claim 1 in which the band has a substantially horizontal lower run, said means for showering tobacco comprising an upwardly extending channel, said trimmer being adjacent to the lower run of the band and the first suction wheel being adjacent the end of the lower run of the band.

3. A cigarette making machine according to claim 1 in which the air-pervious band is substantially wider than the tobacco stream.

4. In a cigarette making machine including conveyor means arranged for movement along a predetermined path, means for showering tobacco onto said conveyor means to build up a continuous tobacco stream thereon and means spaced from said conveyor means for conveying a continuous wrapper web in a direction away from said conveyor means along a substantially horizontal path, the improvement comprising the combination of (a) a first suction wheel, having an air-pervious peripheral surface arranged to travel along a first circular path, a portion of which is adjacent to the path of said conveyor means, and in a direction such that the adjacent portions of said peripheral surface of said first suction wheel and of said conveyor means travel in the same direction, for receiving said tobacco stream smoothly and without disturbance from said conveyor means at a first position along said first circular path and conveying said tobacco stream along said first circular path, and (b) a second suction wheel, having an air-pervious peripheral surface arranged to travel along a second circular path, a portion of which is adjacent to the peripheral surface of said first suction wheel, and in a direction such that the adjacent portions of said peripheral surfaces of said first and second suction wheels travel in the same direction, for receiving said tobacco stream smoothly and without disturbance from the peripheral surface of said first suction wheel at a second position along said first path downstream of said first position, conveying said tobacco stream along a portion of said circular path and depositing it onto the top surface of said continuous wrapper web, (c) said spaced confronting surfaces of said stationary side walls extending along one of said circular paths from a location immediately downstream of the position where said tobacco stream is transferred to said one suction wheel to a location adjacent said position where said tobacco stream is transferred therefrom, the other of said suction wheels including a peripheral groove defined by an air-pervious cylindrical bottom wall and spaced side walls projecting radially from opposite sides thereof, the confronting surfaces of said side walls of said other suction wheel being spaced substantially the same distance as the confronting surfaces of said stationary side walls of said one suction wheel.

* * * * *

UNITED STATES PATENT AND TRADEMARK OFFICE

CERTIFICATE OF CORRECTION

PATENT NO. : 4,122,859

DATED : October 31, 1978

INVENTOR(S) : Edward George Preston

It is certified that error appears in the above-identified patent and that said Letters Patent are hereby corrected as shown below:

Claim 4 should read as follows:

In a cigarette making machine including conveyor means arranged for movement along a predetermined path, means for showering tobacco onto said conveyor means to build up a continuous tobacco stream thereon and means spaced from said conveyor means for conveying a continuous wrapper web in a direction away from said conveyor means along a substantially horizontal path, the improvement comprising the combination of (a) a first suction wheel, having an air-pervious peripheral surface arranged to travel along a first circular path, a portion of which is adjacent to the path of said conveyor means, and in a direction such that the adjacent portions of said peripheral surface of said first suction wheel and of said conveyor means travel in the same direction, for receiving said tobacco stream smoothly and without disturbance from said conveyor means at a first position along said first circular path and conveying said tobacco stream along said first circular path, (b) a second suction wheel, having an air-pervious peripheral surface arranged to travel along a

UNITED STATES PATENT AND TRADEMARK OFFICE

CERTIFICATE OF CORRECTION

PATENT NO. : 4,122,859

DATED : October 31, 1978

INVENTOR(S) : Edward George Preston

It is certified that error appears in the above-identified patent and that said Letters Patent are hereby corrected as shown below:

second circular path, a portion of which is adjacent to the peripheral surface of said first suction wheel, and in a direction such that the adjacent portions of said peripheral surfaces of said first and second suction wheels travel in the same direction, for receiving said tobacco stream smoothly and without disturbance from the peripheral surface of said first suction wheel at a second position along said first path downstream of said first position, conveying said tobacco stream along a portion of said circular path and depositing it onto the top surface of said continuous wrapper web, and (c) spaced stationary side walls having confronting surfaces and extending along said circular path of one of said suction wheels from a location immediately downstream of the position where said tobacco stream is transferred to said one suction wheel to a location adjacent the position where said tobacco stream is transferred therefrom, the other of said suction wheels including a peripheral groove defined by an air-pervious cylindrical bottom wall and spaced side walls having confronting surfaces and projecting radially from opposite sides thereof, the confronting surfaces of said side walls of said other suction wheel being spaced substantially the same distance as the confronting surfaces of said stationary side walls of said one suction wheel.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*